United States Patent [19]

MacDonald et al.

[11] Patent Number: 4,645,283

[45] Date of Patent: Feb. 24, 1987

[54] ADAPTER FOR MOUNTING A FLUORESCENT LAMP IN AN INCANDESCENT LAMP TYPE SOCKET

[75] Inventors: Wallace T. MacDonald, Tewksbury; Frank M. Latassa, Magnolia, both of Mass.

[73] Assignee: North American Philips Corporation, New York, N.Y.

[21] Appl. No.: 719,035

[22] Filed: Apr. 3, 1985

Related U.S. Application Data

[63] Continuation of Ser. No. 455,136, Jan. 3, 1983, abandoned.

[51] Int. Cl.[4] ..... H01R 33/08

[52] U.S. Cl. ..... 339/50 R; 339/154 L; 339/155 L; 339/2 L; 315/56

[58] Field of Search ..... 339/154, 155 L, 157 R, 339/160, 161, 164 L, 158, 147, 198, 65, 168, 52, 53, 64, 50; 315/50, 56–58, 62

[56] References Cited

U.S. PATENT DOCUMENTS

| | | | |
|---|---|---|---|
| 2,422,222 | 6/1947 | Carroll | 339/168 |
| 2,534,361 | 12/1950 | Ludwig | 339/53 |
| 2,702,378 | 2/1955 | Talty | 339/147 P |
| 2,838,739 | 6/1958 | Winkler | 339/64 R |
| 3,058,085 | 10/1962 | Skinner | 339/53 |
| 3,259,870 | 7/1966 | Winkler | 339/198 G |
| 3,551,736 | 12/1970 | Doehner | 315/57 |
| 3,815,080 | 6/1974 | Summa | 339/147 R |
| 4,306,758 | 12/1981 | Johnson et al. | 339/54 |
| 4,360,240 | 11/1982 | Koncelik et al. | 312/238 |
| 4,414,489 | 11/1983 | Young | 315/51 |
| 4,495,443 | 1/1985 | Cummings | 315/56 |

FOREIGN PATENT DOCUMENTS

| | | | |
|---|---|---|---|
| 819561 | 11/1951 | Fed. Rep. of Germany . | |
| 837893 | 5/1952 | Fed. Rep. of Germany . | |
| 1152770 | 2/1958 | France | 339/158 |

*Primary Examiner*—Gil Weidenfeld
*Assistant Examiner*—David L. Pirlot
*Attorney, Agent, or Firm*—David R. Treacy

[57] ABSTRACT

A compact energy-saving discharge lamp adapter with a take-apart feature for easy installation into incandescent lamp fixtures. The two-part adapter unit consists of a discharge lamp socket assembly and a ballast assembly. The discharge lamp socket assembly comprises three different electrical type connectors arranged in a special housing for lamp and ballast assembly attachment. The ballast assembly comprises a ballast, associated connectors, and special housing containing thermal conductive compound and mountable directly on the socket assembly.

15 Claims, 2 Drawing Figures

ADAPTER FOR MOUNTING A FLUORESCENT LAMP IN AN INCANDESCENT LAMP TYPE SOCKET

This is a continuation of application Ser. No. 455,136, filed Jan. 3, 1983 now abandoned.

BACKGROUND OF THE INVENTION

The invention relates to lighting apparatus and particularly to a compact energy saving fluorescent lamp adapter which is easily installed into incandescent lamp sockets.

The substantial rise of energy costs in recent years has focused attention on the use of energy efficient light sources. Fluorescent lamps have, for example, been widely recognized as being more efficient than conventional incandescent lamps. Such fluorescent lamps, which are also referred to as low pressure discharge lamps, have not been used as widely as would be expected in view of the substantial differences in operating costs as compared to incandescent lamps because special ballasts and sockets are required and are not convenient to install in residential applications. For example, a typical table lamp does not easily accommodate a fluorescent lamp and its associated ballast and socket.

Small fluorescent lamps having a length of approximately six inches and utilizing two small diameter side-by-side sealed tubes, which are joined near one end of each tube, are now being marketed by North American Philips Lighting Corporation of Highstown, N.J. The lamps are identified by the trademark "PL*". Such lamps utilize a special base and require an external ballast and special lamp holder. It is not simple to build an adapter which will engage a medium screw socket and also fit in typical table lamps. Such table lamps commonly have a medium screw socket to which is attached a "harp" which has members extending upwardly to support a lampshade. The harps which are commonly used have been designed for use with conventional incandescent lamps, and limit the length as well as the diameter of any light bulb. In the case of the PL* lamp, the harp limits the dimensions of the combination of the PL* lamp, the ballast, and the adapter.

SUMMARY OF THE INVENTION

It is an object of this invention to provide an adapter unit which will permit the use of small compact energy saving lamps such as the North American Philips Lighting Corporation PL* lamp within the physical limitations imposed by portable incandescent lamps employing a harp, and by small incandescent fixtures.

It has been found that these and other objects of this invention may be attained in a take-apart adapter unit which is comprised of a specially designed socket assembly and a specially designed ballast assembly. The take-apart feature allows easy installation into most incandescent lamp sockets, because the socket assembly is configured to define a relatively slim envelope, while the adapter with ballast installed has a transverse section greater than that of the slim envelope.

The lamp socket assembly is comprised of three different types of connectors, with associated internal wiring and housing. The first connector may be a medium screw base which connects the incoming line to the lamp socket assembly. This first connector connects two conductors, one of which terminates at one of two second connector contacts and the other which terminates at one of two third connector contacts. A third conductor in the lamp socket assembly connects the second contact of the second connector to the second contact of the third connector.

The second connector may be a quick connect lamp terminal and the third connector may be a female type pin connector.

The ballast assembly is comprised of a pair of connector contacts with associated wiring, ballast, housing and thermal compound. The ballast is connected in series to the connector contacts which may be male type pin contacts.

To engage the ballast to the lamp socket assembly, the male connector contacts on the ballast assembly are plugged into the female connector contacts of the lamp socket assembly's third connector. The mounting of the ballast assembly to the lamp socket assembly is accomplished by spaced apart, generally parallel, lip surfaces on external surfaces of both assemblies which allows an interlocking sliding fit. The first and second contacts on the ballast assembly may comprise elongated pin members.

In each form of the invention the first connector may be carried on the socket housing by a torque-limiting slip device which allows relative rotational movement.

BRIEF DESCRIPTION OF THE DRAWING

The invention will be better understood by reference to the accompanying drawing in which.

DESCRIPTION OF THE PREFERRED EMBODIMENT

Figure 1:
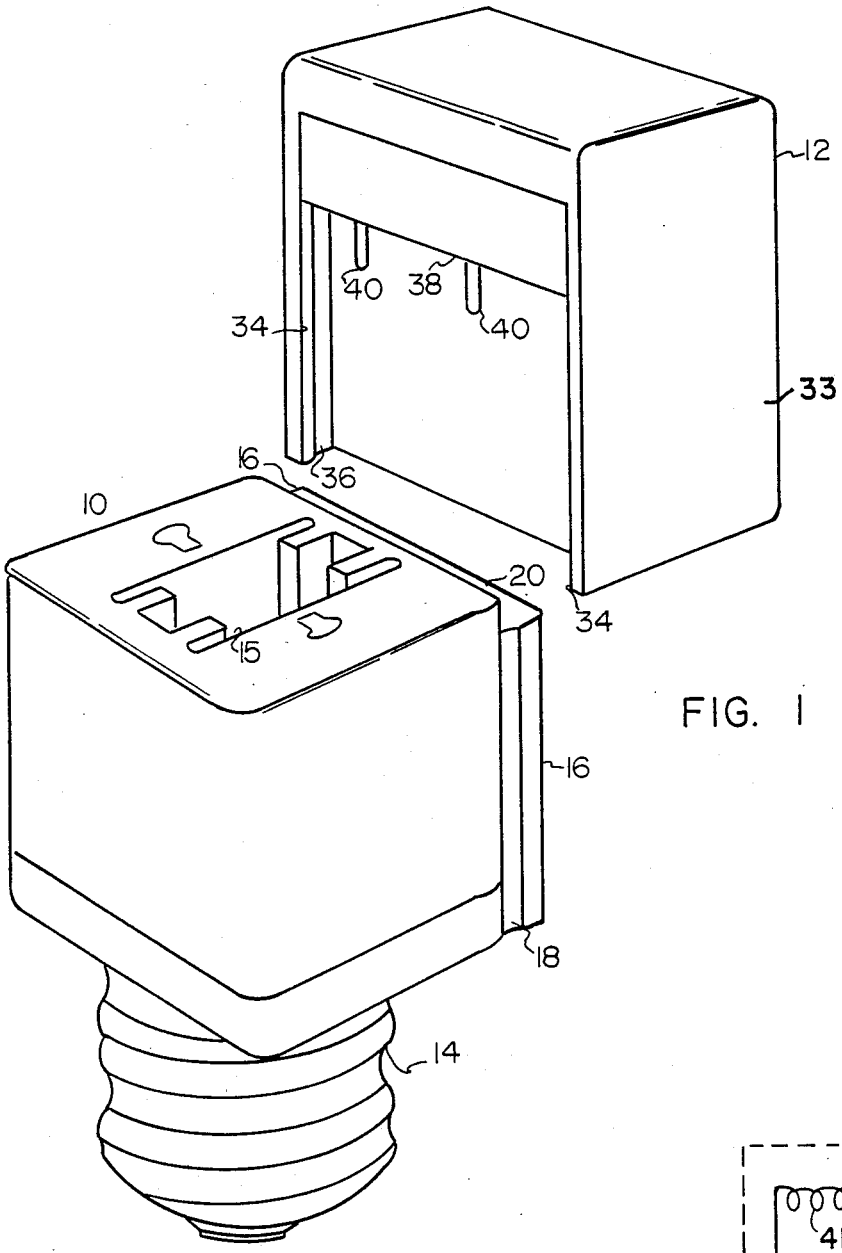
FIG. 1 is a perspective view showing the socket assembly of the adapter and the separate inductive ballast assembly in exploded relationship.
Figure 2:
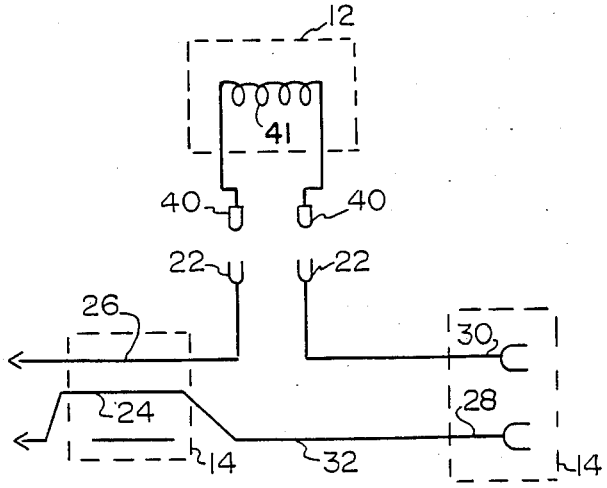
FIG. 2 is an electrical schematic of the lamp socket assembly and ballast assembly.

Referring to FIGS. 1 and 2 there is shown a socket assembly 10 which cooperates with a ballast assembly 12. The socket assembly 10 is provided with a medium screw base 14 which is a conventional base for incandescent lamps used in the United States. It will be understood that although the preferred embodiment utilizes a medium screw base 14 that for other applications including applications in other countries the base used in place of the medium screw base 14 may be of a different design so as to interface with whatever sockets are commonly available.

The medium screw base 14 is preferably a rotating contact type base sold by Leviton of 59–25 Little Neck Parkway, Little Neck, N.Y. 10362 and referred to as a ratchet base. This base is described in a recently issued United States Patent. This base has the feature that the threaded metal portion of the base slips to allow rotation with respect to lamp socket assembly 10 of the adapter.

In normal usage the ratchet base is combined with a socket. When an adapter engages an incandescent socket the ratchet base allows relative rotational movement when tightened. When the adapter is being removed by rotation in the opposite direction the ratchet locks and allows removal. The bases of this type were originally intended to prevent a user from applying too great a torque to the incandescent lamp socket by the adapter during installation.

The present invention utilizes the rotational action of the commercially available base for an entirely different purpose as will be apparent from the description of the operation of the apparatus in accordance with the invention. The socket assembly 10 is provided with a cavity or recess 15 on an end face opposite to that of the end or face from which the medium screw base 14 extends. The recess 15 is dimensioned and configured for accommodation of the base of lamps such as the North American Philips PL* lamp.

Disposed along a side face of the socket assembly 10, to one side of the axis of the screw base 14, is a pair of generally parallel lips or ribs 16, 16 which are respectively spaced apart from the main housing portion of the socket assembly by respective grooves 18 (one shown). Disposed intermediate the ribs is a step 20 which extends generally transversely to the ribs 16, 16. The step 20 is provided with two socket type terminal contacts 22, 22. The medium screw base 14 has first and second conductors 24, 26 and the recess or second connector end of the socket assembly 10 also has first and second conductors 28, 30. The first conductor 24 is connected by a conductive element 32 to the first conductor 28. The second conductor 26 is connected to a terminal contact 22 and the second conductor 30 is also connected to a terminal contact 22.

The ballast assembly 12 contains a ballast winding 41 connected electrically between two electrical terminal contacts 40. The physical arrangement of these contacts is described below. The winding 41 is preferably mounted in a housing 13 which is filled with a thermally conductive compound. The compound prevents overheating of the winding 41 by conducting the winding heat loss to the walls of the housing 33 from which the heat is readily dissipated into the air surrounding the ballast assembly.

The housing 33 of the ballast assembly 21 is provided with two spaced apart, generally parallel, lips or ribs 34 which are spaced apart from the main body of the ballast assembly by respective grooves 36 adjacent to each rib 34. Disposed intermediate the ribs 34, 34 is a step 38 which extends generally transversely to the direction of the ribs 34, 34. Mounted on the step 38 are two spaced elongated terminal contact 40, 40. These terminal contacts 40, 40 are connected to the ballast winding 41. The spaced elongated terminal contacts 40, 40 are dimensioned and configured as well as oriented for cooperation with the socket type terminal contacts 22, 22 disposed on the step 20 of the socket assembly 10. More particularly, the ribs 34 and slots 36 of the ballast assembly 12 are dimensioned and configured for respective engagement with the slots 18 and ribs 16 of the socket assembly 10 so that the user may move the ballast with respect to the body in a direction which is generally parallel to the direction of the respective ribs 16, 34 which are themselves disposed in generally parallel relationship. Movement of the ballast assembly 12 with respect to the body in this manner automatically positions the elongated terminal contacts 40, 40 of the ballast 12 with respect to the socket type terminal contacts 22, 22 of the body so that proper electrical connection between them is made. The limit on the maximum travel of the ballast assembly 12 with respect to the socket assembly 10 is defined by abutment of the steps 20, 38.

In operation, the user who has a lamp, such as a table lamp with a harp for holding a lampshade (none of which are shown), separates the ballast assembly 12 from the socket assembly 10 by sliding relative movement to disengage the respective terminal contacts 22, 40 as well as respective ribs 34, 16. The socket assembly is then positioned with the medium screw base proximate to the socket of the table lamp and rotated about the axis of the medium screw base to firmly engage the base with the socket. The slim envelope defined by the socket assembly permits this rotation within a harp or other device which limits the maximum radial dimension of the transvese section of the assembly being rotated about the screw base axis. Still further rotation of the socket assembly 10 with respect to the threaded portion of the base is possibly because of the action of the ratchet base. The user will continue this rotation to position the ribs in a direction which is convenient for mounting of the ballast assembly. Ordinarily this will occur when the face of the socket assembly 10 on which the ribs 16 are disposed is parallel to a plane defined by the elements of the harp. The user may then install the ballast assembly 12 by engagement of the ribs 34 and slots 36 thereof with the slots 18 and ribs 16 of the socket assembly 10.

What is claimed:

1. An adapter unit for a single-ended fluorescent lamp, comprising a socket assembly comprising a first connector for mounting the assembly to and receiving electrical power from a source, a lampholder portion including a second connector for electrical connection to a lamp, said second connector defining an axial direction, said portion being adapted for connecting a lamp to said socket assembly by inserting the lamp in said axial direction into the lampholder portion, and a third connector for electrical connection to a ballast assembly, a ballast assembly, and means for electrically connecting said ballast assembly to said third connector, characterized in that said socket assembly includes means for removably mounting said ballast assembly on an external surface of said socket assembly by engagement of interlocking sliding surfaces extending in a given direction on external surfaces of the socket and ballast assemblies respectively, the socket assembly and ballast assembly are each configured such that the adapter defines an envelope having a traverse section greater than a corresponding transverse section of the socket assembly, and said means for electrically connecting comprises two electrical contacts on said socket assembly independent of said sliding surfaces, and two respective electrical contacts on said ballast assembly independent of said sliding surfaces, arranged such that electrical connection between respective contacts is established by sliding the ballast assembly into said engagement with said socket assembly, the length of interlocking surface engagement, in said given direction, being greater than the length of electrical contact engagement in said given direction.

2. A unit as claimed in claim 1, characterized in that said two electrical contacts on said socket assembly are female contacts extending parallel to said given direction, and said two electrical contacts on the ballast assembly are male contacts extending parallel to said given direction.

3. A unit as claimed in claim 2, characterized in that said sliding surfaces include spaced apart generally parallel lip surfaces on at least one of said assemblies.

4. A unit as claimed in claim 2, characterized in that said socket assembly has two opposite ends, said lampholder portion includes a cavity open toward one end of the socket for receiving a mounting portion of a lamp and defining said axial direction, said interlocking surfaces extend parallel to said axial direction, and said female contacts are open toward the same end of the socket assembly as said cavity, whereby the ballast is mounted by sliding relative to the socket in the same direction as lamp insertion.

5. A unit as claimed in claim 4, characterized in that said sliding surfaces include spaced apart generally parallel lip surfaces on at least one of said assemblies.

6. An adapter unit for a single-ended fluorescent lamp, comprising a socket assembly having two opposite ends, comprising a first, threaded male connector at one end of the socket assembly, defining an axis, for mounting the assembly to and receiving power from a source, a lampholder portion at the other end of the socket assembly, having a cavity extending coaxially with said first connector for receiving a lamp base by inserting the base into the cavity, and including a second connector for electrical connection to a lamp so inserted, a third connector for electrical connection to a ballast assembly, and means for electrically connecting said ballast assembly to said third connector, characterized in that said socket assembly includes a housing, and means for removably mounting said ballast assembly to an external surface of said housing, entirely to one side of said axis and between said ends, the socket assembly and ballast assembly are each configured such that the adapter defines an envelope having a traverse section greater than a corresponding transverse section of the socket assembly, said means for electrically connecting comprises two electrical contacts on said socket assembly independent of said means for removably mounting, and two respective electrical contacts on the ballast assembly independent of said means for removably mounting, arranged such that electrical connection is established by mounting the ballast assembly on the socket, and said socket assembly further includes means, responsive to application of a torque to the housing greater than the torque required to screw the threaded male connector into a power source, for permitting rotation of the housing about said axis with respect to the threaded male connector in the direction of rotation in which the threaded connector is screwed into a power source.

7. A unit as claimed in claim 6, characterized in that said second connector is so arranged that a lamp is inserted by rectilinear movement only of said lamp into the lampholder portion.

8. A unit as claimed in claim 6, characterized in that said means for permitting is a ratchet base.

9. A unit as claimed in claim 8, characterized in that said second connector is so arranged that a lamp is inserted by rectilinear movement only of said lamp into the lampholder portion.

10. An adapter unit for a single-ended fluorescent lamp, comprising a socket assembly having two opposite ends, comprising a first, threaded male connector at one end of the socket assembly, defining an axis and axial direction, for mounting the assembly to and receiving power from a source, a lampholder portion at the other end of the socket assembly, having a cavity extending coaxially with said first connector for receiving a lamp base by inserting the base into the cavity, and including a second connector for electrical connection to a lamp so inserted, a third connector for electrical connection to a ballast assembly, and means for electrically connecting said ballast assembly to said third connector, characterized in that said socket assembly includes a housing and means including interlocking sliding surfaces on external surfaces of the socket and ballast assembly respectively, extending in said axial direction, for removably mounting said ballast assembly to said housing, entirely to one side of said axis and between said ends, the socket assembly and ballast assembly are each configured such that the adapter defines an envelope having a traverse section greater than a corresponding transverse section of the socket assembly, said means for electrically connecting comprises two electrical contacts on said socket assembly independent of said sliding surfaces, and two respective electrical contacts on said ballast assembly independent of said sliding surfaces, arranged such that electrical connection between respective contacts is established by sliding the interlocking surfaces of the ballast assembly into engagement with said surfaces of the socket assembly, the length of interlocking surface engagement, in said axial direction, being greater than the length of electrical contact engagement in said given direction, and said socket assembly further includes means, responsive to application of a torque to the housing greater than the torque required to screw the threaded male connector into a power source, for permitting rotation of the housing about said axis with respect to the threaded male connector in the direction of rotation in which the threaded connector is screwed into a power source.

11. A unit as claimed in claim 10, characterized in that said sliding surfaces include spaced apart generally parallel lip surfaces on at least one of said assemblies.

12. A unit as claimed in claim 10, characterized in that said two electrical contacts on said socket assembly are female contacts extending parallel to said assembly direction, and said two electrical contacts on the ballast assembly are male contacts extending parallel to said axial direction.

13. A unit as claimed in claim 12, characterized in that said female contacts are open toward the same end of the socket as said cavity, whereby the ballast is mounted by sliding relative to the socket in the same direction as lamp insertion.

14. A unit as claimed in claim 13, characterized in that said second connector is so arranged that a lamp is inserted by rectilinear movement only of said lamp into the lampholder portion.

15. A unit as claimed in claim 14, characterized in that said sliding surface include spaced apart generally parallel lip surfaces on at least one of said assemblies.

* * * * *

UNITED STATES PATENT AND TRADEMARK OFFICE

CERTIFICATE OF CORRECTION

PATENT NO. : 4,645,283

DATED : February 24, 1987

INVENTOR(S) : WALLACE T. MACDONALD, FRANK M. LATASSA

It is certified that error appears in the above-identified patent and that said Letters Patent is hereby corrected as shown below: On the title page IN THE INVENTORS NAME:
change "MacDonald" to --Macdonald--

IN THE CLAIMS:
Claim 1, line 25 (col. 4, line 45), change "traverse" to --transverse--
Claim 6, line 26 (col. 5, line 41), change "traverse" to --transverse--
Claim 10, line 28 (col. 6, line 27), change "traverse" to --transverse--

Signed and Sealed this

Nineteenth Day of January, 1988

*Attest:*

DONALD J. QUIGG

*Attesting Officer*

*Commissioner of Patents and Trademarks*